US010167699B2

(12) United States Patent
Harestad

(10) Patent No.: US 10,167,699 B2
(45) Date of Patent: Jan. 1, 2019

(54) EXPANDABLE DEVICE FOR FORMING A CEMENT PLUG

(71) Applicant: PERIGON AS, Randaberg (NO)

(72) Inventor: Kristian Harestad, Randaberg (NO)

(73) Assignee: PERIGON AS, Randaberg (NO)

( * ) Notice: Subject to any disclaimer, the term of this patent is extended or adjusted under 35 U.S.C. 154(b) by 0 days.

(21) Appl. No.: 15/551,392

(22) PCT Filed: Feb. 12, 2016

(86) PCT No.: PCT/EP2016/053044

§ 371 (c)(1),
(2) Date: Aug. 16, 2017

(87) PCT Pub. No.: WO2016/131726

PCT Pub. Date: Aug. 25, 2016

(65) Prior Publication Data

US 2018/0030809 A1 Feb. 1, 2018

(30) Foreign Application Priority Data

Feb. 16, 2015 (NO) ..... 20150226

(51) Int. Cl.
*E21B 33/136* (2006.01)
*E21B 33/134* (2006.01)
*E21B 23/10* (2006.01)

(52) U.S. Cl.
CPC ..... *E21B 33/134* (2013.01); *E21B 23/10* (2013.01); *E21B 33/136* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,369,891 | A * | 3/1921 | Halliburton | E21B 33/16 166/153 |
| 2,969,839 | A * | 1/1961 | Greene | E21B 33/136 166/117 |
| 3,079,997 | A | 3/1963 | Blydorp | |
| 3,572,433 | A | 3/1971 | Conrad | |
| 4,491,178 | A | 1/1985 | Terrell et al. | |
| 5,667,015 | A * | 9/1997 | Harestad | E21B 33/136 166/153 |
| 6,050,336 | A | 4/2000 | Willauer et al. | |
| 2003/0066648 | A1 | 4/2003 | McMahan | |
| 2004/0112599 | A1 * | 6/2004 | Holt, Jr. | E21B 21/103 166/285 |

(Continued)

OTHER PUBLICATIONS

International Search Report issued in PCT/EP2016/053044 dated May 20, 2016 (4 pages).

(Continued)

*Primary Examiner* — D. Andrews
*Assistant Examiner* — Ronald R Runyan
(74) *Attorney, Agent, or Firm* — Osha Liang LLP

(57) ABSTRACT

A cementing device for establishing a false bottom in a well bore for formation of a cement plug in the well bore. The cementing device includes a tool body which has a front end and a rear end. The cementing device further includes at least one propulsion device which is attached to the front end and/or the rear end of the tool body and is adapted for being propelled by a fluid.

13 Claims, 4 Drawing Sheets

(56) References Cited

U.S. PATENT DOCUMENTS

| | | | | |
|---|---|---|---|---|
| 2004/0112602 | A1 | 6/2004 | Arebrat | |
| 2008/0190611 | A1 | 8/2008 | Tjorswaag et al. | |
| 2009/0242191 | A1* | 10/2009 | Wildman | E21B 33/16 166/177.3 |
| 2014/0034301 | A1 | 2/2014 | Leblanc | |
| 2014/0238694 | A1 | 8/2014 | Fraser et al. | |

OTHER PUBLICATIONS

Written Opinion of the International Searching Authority issued in PCT/EP2016/053044 dated May 20, 2016 (4 pages).
Written Opinion of the International Preliminary Examining Authority issued in PCT/EP2016/053044, dated Jan. 30, 2017 (6 pages).
International Preliminary Report on Patentability from PCT/EP2016/053044, dated Jun. 22, 2017 (16 pages).
Norwegian Search Report issued in No. 20150226 dated Sep. 16, 2015 (2 pages).
Halliburton: "Halliburton Plug Setting Aids", 31.12.2013, XP0555271273. Retrieved from the Internet: URL:http://www.halliburton.com/public/cem/contents/books_and_catalogs/tech/sect13_ce.pdf (Retrieved on May 9, 2016), pp. 13-1-13-14. (14 pages).

* cited by examiner

EXPANDABLE DEVICE FOR FORMING A CEMENT PLUG

One or more embodiments of the invention are related to a cementing device for establishing a false bottom in a well bore for formation of a cement plug in the well bore.

For various reasons it may at times be desirable or necessary to provide a seal in a well bore. Such a seal can be created by establishing a cement plug in bore hole at the desired location. There are, however, a number of situations potentially associated with establishing a cement plug at a desired location in a well bore.

When a cement plug is placed off bottom in the well bore, it is quite common that it is not found at the location where it is expected to be placed, but further down the well bore. If the cement plug is found in the correct position, it is often found that the cement plug is soft or that it does not provide a tight seal. Other reasons for improper placement of a cement plug or a poor quality of the cement plug includes poor mud removal, poor estimation of well parameters such as temperature, poor slurry design and angle of the well. If the cement plug is placed in the wrong place or is of a poor quality, the plug may not fulfill its requirements and a new attempt to set the cement plug may be required. The expected success rate in the industry is above two which means that on average one must expect to set at least two cement for every successful setting of a cement plug. Obviously this low success rate when trying to set a cement plug in a well bore is time consuming and costly.

One or more embodiments of the present invention may therefore improve the success rate for the setting of a cement plug in a well bore.

This is achieved with a cementing device as defined in claim 1. Further embodiments of the cementing device is defined in the dependent claims 2-14.

One or more embodiments of the present invention involves may involve creating a false bottom in the well bore at the desired position in the well bore and ensuring that the cementing device used for that purpose arrives at the desired position. The cementing device is designed to be pushed through a transport pipe, which is typically the drill pipe, by a fluid to the end of the transport pipe. To ensure that the cementing device is transported through the transport pipe, the cementing device is provided with a propulsive device. As the cementing device comes out of the end of the transport pipe, a bottom element of the cementing device is expanded such that a false bottom is created within the well bore. This false bottom will ensure that the cement slurry which is pumped down the transport pipe after the cementing device, forms a cement plug at the desired location in the well bore.

Hence, there is provided a cementing device for establishing a temporary bottom in a well bore for formation of a cement plug in the well bore, where the cementing device comprises a tool body which has a front end and a rear end, the cementing device further comprising at least one propulsion device which is attached to the front end and/or the rear end of the tool body and is adapted for being propelled by a fluid.

The tool body is generally an elongated body and the front end of the tool body should be understood to be the end which comes first in the transport pipe as the cementing device is transported through the transport pipe. The rear end is at the opposite end of the tool body.

The cementing device may be adapted for transport through a transport pipe, for example a drill pipe or another suitable pipe. When the cementing device has been transported through the transport pipe and comes out of the end of the transport pipe, the bottom element or elements are expanded forming a false bottom on which a cement plug may be formed.

The propulsion device may be detachably attached to the tool body of the cementing device, for example by a threaded connection, a quick connection or any other suitable connection. Propulsion devices adapted for transport pipes having different inner diameters may therefore be used with the same tool body.

The largest outer diameter of the propulsion device may be substantially the same as the inner diameter of the transport pipe such that the cementing device can be efficiently transported by a fluid through the transport pipe. The propulsion device may of course also be provided with an outer diameter which is smaller than the inner diameter of the transport pipe if that is necessary.

The propulsion device may comprise a core part and at least one propulsive element extending radially from the core part. The propulsive element may for example be a dish-like element which covers substantially the whole cross-sectional area of the transport pipe. The propulsive element may be made of a flexible material, such as a plastic or rubber material, and could be designed with a larger diameter than the inner diameter of the transport pipe such that the propulsive element or elements presses against the inner wall of the transport pipe as the cement tool is pumped through the transport pipe by a fluid. The propulsive element may also be cone shaped with a top end, i.e. the apex, which may point in the direction of travel of the cementing device through the transport pipe.

A rear end of the core part of the propulsion device may be adapted for attachment to the front end of the tool body. Furthermore, a front end of the core part of the propulsion device may be adapted for attachment to the rear end of the tool body. Thus, it would be possible to attach a propulsion device to both the front end and the rear end of the tool body.

The propulsive device may further be adapted for attachment to a second propulsive device. A string of two or more propulsive devices could therefore follow each other where a string of propulsive devices may be attached to the front end and/or rear end of the tool body.

The tool body may comprise at least one foldable and expandable bottom element. The at least one bottom element may be foldable into a transport state and expandable from the transport state into an expanded state wherein the at least one bottom element substantially covers the cross-sectional area of the well bore and forms a false bottom in the well bore during the formation of a cement plug. The at least one bottom element can be made of a foldable material such as a canvas material. Thus, the cementing device is transported through the transport pipe in a transport state wherein the bottom element is folded such that it is compact and takes up little space.

The tool body may further comprise a plurality flexible ribs to which the bottom element is attached, where the flexible ribs are adapted to expand the at least one bottom element in the well bore such that the bottom element substantially covers the cross sectional area of the well bore. The ribs can be made of a metal, such as steel, having the necessary spring properties enabling the ribs to expand the bottom element or elements when the cement tool exits the end of the transport pipe.

The ribs may be produced with a curved shape and attached to a central element of the tool body. As the cementing device is inserted into the transport pipe, the ribs are pre-tensioned and the bottom element or elements folded. Later, when the cementing device exits the transport pipe, the pre-tensioning of the ribs causes them to expand into their curved shape and thereby expands the bottom element or elements which forms a false bottom in the well bore for use in the formation of a cement plug.

Alternatively, at least one end of the ribs may be mounted on a ring which is slidably mounted on the central element of the tool body. In the transport position, the ring may be spring loaded by the ribs and held in a position where the ribs are substantially straight while the at least one bottom element is folded within the ribs. When the cementing device has been transported through the transport pipe and exits the transport pipe, the ring is triggered and the ribs moves back to their originally curved shapes, causing the at least one bottom to expand and form a false bottom for use in the formation of a cement plug. Another way of causing the ribs to bend outwards would be to use straight ribs and a ring which is attached to a spring element causing the ring to move when the ring is triggered to move as the cementing device exits the transport pipe and thereby causing the ribs to bend outwards and the at least one bottom to expand and form a false bottom in the well bore.

The cementing device may be provided with a detachable push device at the rear end of the tool body of the cementing device for facilitating insertion of the cementing device into the transport pipe. The push device can for example be a substantially flat plate which is attached to the tool body with a threaded connection, a quick connection or any other suitable connection. When the cementing device is inserted into the transport pipe, the push device makes it easier for a person to push on the cementing device. After the cementing device has been inserted into the transport pipe, the push device may be removed before the cementing device is transported through the transport pipe.

one or more non-limiting embodiments of the present invention will be explained in detail below with reference to the figures where FIG. 1 illustrates a cementing device arranged in a transport casing.

In FIGS. 1-4 one or more embodiments of the cementing device 10 according to the present invention are shown in detail. The same features have the same reference numbers in all figures.

Figure 1:
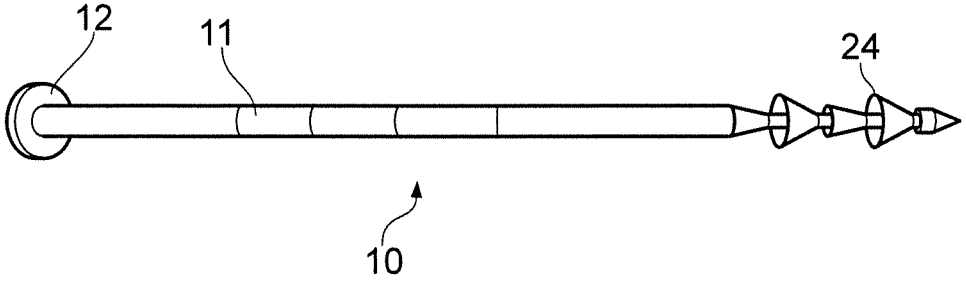

In FIG. 1 the cementing tool 10, comprising a tool body 14 and a propulsive element 24, is shown where the tool body 14 is arranged in a transport casing 11. The transport casing 11 may comprise an end flange 12 which may be used to push the cementing tool into a transport pipe 32 through which the cementing device is to be transported (see FIG. 4).

Figure 2:
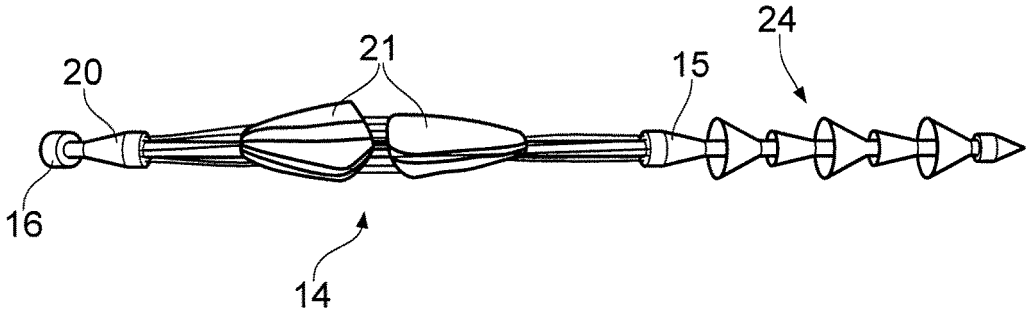
FIG. 2 illustrates the cementing device with the ribs and the at least one bottom in a collapsed, transport state.
Figure 3:
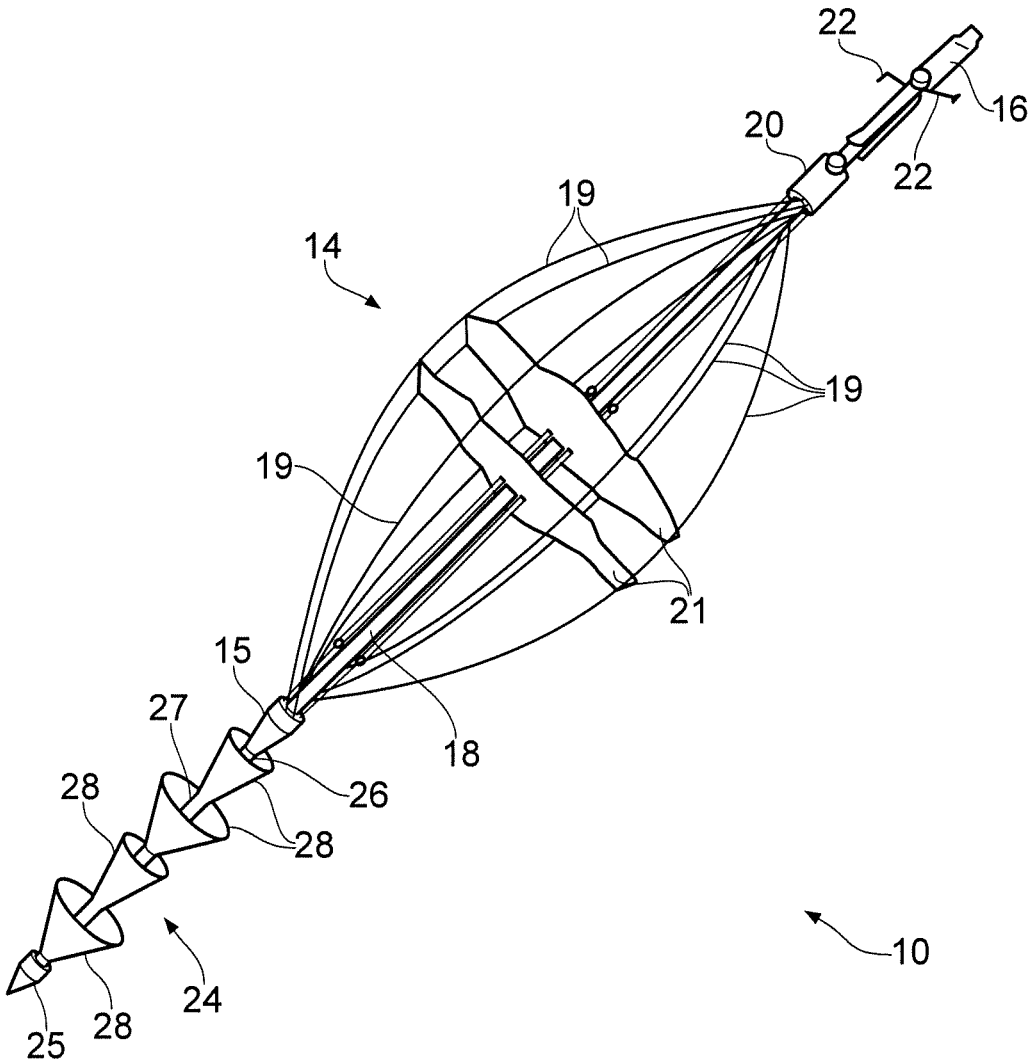
FIG. 3 illustrates the cementing device in FIG. 2 in an expanded state.

The tool body 14 comprises a front end 15 and a rear end 16. Between the front end 15 and the rear end 16 there may be arranged a core element 18 to make the tool body sufficiently stiff. The tool body further comprises a number of ribs 19, which are made of springy steel. The ribs 19 are attached to the front end of the core element 18 in one end and to a fastening element 20 in the other end. The fastening element 20 is movable along the core element 18 and may be attached to one or more spring elements. A locking mechanism (not shown in detail) locks the fastening element 20 in a transport position where the ribs 19 are more or less parallel to the core element 18 and the bottom element 21 or bottom elements 21 are folded as shown in FIG. 2. The fastening element 20 may be attached to one or more spring elements which are attached to for example the front end 15 of the tool body 14. When the tool body 14 is arranged in the transport position where the ribs 19 are substantially parallel to the core element 18 of the tool body 14, the spring elements will be pretensioned, and as soon as the fastening element 20 is released by the locking mechanism, the spring elements move the fastening element 20 along the core element which causes the ribs to bend into a curved shape as indicated in FIG. 3. Alternatively the ribs 19 themselves may be formed with an inherent curved shape as shown on FIG. 3 and thereby act as spring elements which means that when the tool body is arranged in the transport position shown in FIG. 2, the ribs 19 will be pre-tensioned and as soon as the fastening element 20 is released, the ribs will assume their curved positions as indicated in FIG. 3.

At least one, but possibly two or more foldable bottom elements 21 are attached to the ribs 19. The bottom elements 21 may be made of a canvas or any other suitable material which is so strong that it can carry the weight of the cement plug to be formed on top of the bottom element. The material must also be foldable into a transport position where the diameter of the cementing device is such that the cementing device 10 will fit into the transport pipe 32 which is typically a drill pipe.

Figure 4:
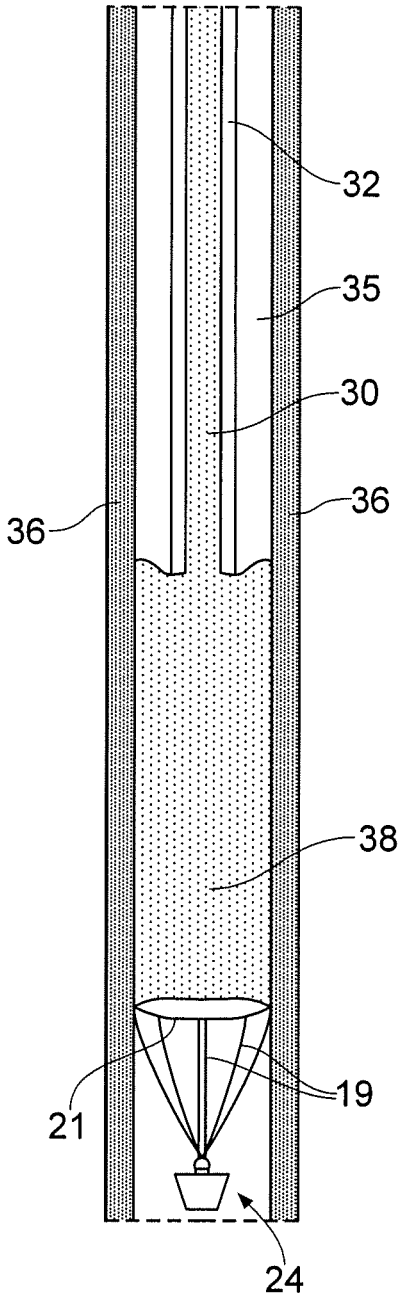
FIG. 4 illustrates a cementing device in a well bore and a cement plug being formed on the false bottom formed by the cementing device.

The locking mechanism comprises at least one, but possibly two or more trigger elements 22 which in the transport position, when the cementing device is being transported through the transport pipe, are more or less parallel with the core element 18. The trigger elements 22 are, however, provided with spring elements which presses the trigger elements towards the inner wall of the transport pipe 32. When no external force, i.e. a force from the inner wall of the transport pipe, keeps the trigger devices 22 in their transport positions, the trigger devices 22 are pushed out into a radial expansion position as indicated in FIG. 3. This will happen when the cementing tool comes out of the end of the transport pipe 32. When the trigger elements 22 are moved into the expansion position, the fastening element 20 is released and spring elements move the ribs 19 into the expanded position as shown in FIG. 3 pressing against the formations 36 of the well bore as indicated in FIG. 4. The ribs 19 expands the bottom elements 21 which forms a false bottom in the well bore on which a cement plug may be formed.

The cementing 10 tool further comprises at least one propulsive device 24, comprising a front end 25 and a rear end 26, which will help to propel the cementing tool through the transport pipe 32. The propulsive device 24 may be attached to the tool body 14 with any suitable connection such as a threaded connection. The embodiment of the cementing device 10 shown in the figures is provided with a propulsive device 24 where the rear end 26 of the propulsive device 24 is connected to the front end 15 of the tool body 14. It should be understood that it would of course be possible to connect the front end 25 of propulsive device 24 to the rear end 16 of the tool body 14. It would also be possible to connect a propulsive device 24 to both the front end 15 and the rear end 16 of the tool body 14 or to connect a string of two or more propulsive devices 24 connected to each other, to the front end 15 and/or to the rear end 16 of the tool body 14.

The cementing tool 10 will typically be pumped through the transport pipe 32 using a fluid, and the propulsive device 24 is therefore provided with one or more propulsive elements 28 which may be conic elements attached to a core part 27 of the propulsive device 24 arranged with their pointed ends towards the direction of travel through the transport pipe 32. At least one of the propulsive elements 28 may be made of an elastic material and provided with a maximum outer diameter which is substantially the same as or slightly larger than the inner diameter of the transport pipe 32 such that said at least one propulsive element 28 presses against the inner wall of the transport pipe 32 and the fluid which is used to pump the cementing device through the transport pipe, does not pass the cementing device 10.

In use, the cementing device 10 is brought to the place where it will be inserted into the transport pipe 32 with the tool body 14 arranged in the transport casing 11. The end of the transport pipe, which may be a drill string, is arranged in a position in the well bore where it is desired that a cement plug is to be formed. As long as the tool body 14 is positioned in the transport casing 11, the trigger elements 22 will be prevented from moving and causing the ribs 19 to expand. The cementing device 10 with the transport casing 11 is inserted into the transport pipe 32. The transport casing is removed and the cementing tool 10 is ready to be transported through the transport pipe. A fluid, usually cement slurry for the cement plug, is used to pump the cementing tool 10 through the transport pipe 32, but other fluids may also be used. The propulsive device 24 makes sure that the cementing device 10 is pumped efficiently through the transport pipe 32. As the rear end 16 of the tool body 14 exits the end of the transport pipe the trigger elements 22 will move an release the fastening element 20 which causes the ribs 19 to expand and consequently expands the foldable bottom elements 21. The cement slurry is thereby prevented from flowing further down or into the well bore and is forced to flow up into the annulus 35 which is formed between the transport pipe 32 and the formations 36 of the well bore. When the false bottom has been formed, cement slurry 30 is pumped down the transport pipe until a cement plug 38 (as indicated in FIG. 4) of a desired size has been formed.

As mentioned above, it should be understood that the cementing tool may also be pumped through the transport pipe and set in the desired position in the well bore with another fluid than cement slurry whereafter cement slurry may be pumped into the well bore to form the cement plug. It should also be noted that more than one cementing tool may be pumped through the transport pipe to ensure that at least one of them will function properly and create the false bottom needed to form the cement plug.

The invention claimed is:

1. A cementing device for establishing a bottom in a well bore for formation of a cement plug in the well bore, where the cementing device is adapted for transport into the well bore through a transport pipe, the cementing device comprising:

a tool body having a front end and a rear end, at least one bottom element, the at least one bottom element being foldable into a transport position and expandable into an expanded position, at least one propulsion device for propulsion of the cementing device by a fluid through the transport pipe, wherein the propulsion device comprises at least one propulsive element extending radially and substantially covering a cross-sectional area of the transport pipe, wherein the at least one propulsion device is detachably attached to the front end of the tool body and/or the rear end of the tool body such that the cementing device can be used with propulsion devices adapted for transport pipes having different inner diameters, and wherein the tool body comprises a plurality of flexible ribs to which the at least one bottom element is attached, the ribs being attached to a fastening element that is moveable along a core element of the tool body, the tool body further comprising a locking mechanism that is capable of locking the fastening element in said transport position and releasing the fastening element for expansion of the at least one bottom element.

2. The cementing device according to claim 1, wherein the propulsive element is a conic element with a top end that points in a direction of travel of the cementing device.

3. The cementing device according to claim 1, wherein the propulsive device is further adapted for attachment to a second propulsive device such that a string of propulsive devices is formed and is attached to the tool body.

4. The cementing device according to claim 1, wherein the at least one bottom element is foldable into a transport state and expandable from the transport state into an expanded state wherein the at least one bottom element substantially covers the cross-sectional area of the well bore and forms a false bottom in the well bore during the formation of the cement plug.

5. The cementing device according to claim 1, wherein the tool body further comprises a plurality of flexible ribs to which the at least one bottom element is attached, wherein the flexible ribs are adapted to expand the at least one bottom element in the well bore such that the at least one bottom element substantially covers the cross sectional area of the well bore.

6. The cementing device according to claim 1, wherein the at least one bottom element is made of a foldable material.

7. The cementing device according to claim 1, wherein the cementing device comprises a removable transport casing in which at least the tool body of the cementing device is arranged for facilitating insertion of the cementing device into the transport pipe.

8. Cementing device according to claim 1, wherein the cementing device comprises at least one trigger element that is provided with a spring element, the at least one trigger element being adapted to press against an inner wall of the transport pipe when the cementing tool is transported through the transport pipe, and to be moved into a radial expansion position when the cementing device comes out of the transport pipe and thereby releasing the fastening element whereby the ribs expand the at least one bottom element from the transport position into the expanded position.

9. A cementing device for establishing a bottom in a well bore for formation of a cement plug in the well bore where the cementing device is adapted for transport into the well bore through a transport pipe, the cementing device comprising:

a tool body which has a front end and a rear end, at least one bottom element, the at least one bottom element being foldable into a transport position and expandable into an expanded position, the cementing device further comprising at least one propulsion device for propulsion of the cementing device by a fluid through the transport pipe, wherein the propulsion device comprises at least one propulsive element extending radially and substantially covering the cross-sectional area of the transport pipe, and wherein the tool body comprises a plurality of flexible ribs to which the at least one bottom element is attached, the ribs being attached to a fastening element that is moveable along a core element of the tool body, the tool body further comprising a locking mechanism that is capable of locking the fastening element in said transport position and releasing the fastening element for expansion of the at least one bottom element.

10. Cementing device according to claim 9, wherein the at least one propulsion device is detachably attached to the front end of the tool body and/or the rear end of the tool body.

11. Cementing device according to claim 9, wherein the propulsive device is further adapted for attachment to a second propulsive device such that a string of propulsive devices are formed which is attached to the tool body.

12. Cementing device according to claim 9, wherein the at least one bottom element is foldable into a transport state and expandable from the transport state into an expanded state wherein the at least one bottom element substantially covers the cross-sectional area of the well bore and forms a false bottom in the well bore during the formation of a cement plug.

13. Cementing device according to claim 9, wherein the cementing device comprises a removable transport casing in which at least the tool body of the cementing device is arranged for facilitating insertion of the cementing device into the transport pipe.

* * * * *